US007468708B2

(12) United States Patent
Park et al.

(10) Patent No.: US 7,468,708 B2
(45) Date of Patent: Dec. 23, 2008

(54) MOBILE TERMINAL AND MOBILE TERMINAL ANTENNA FOR REDUCING ELECTROMAGNETIC WAVES RADIATED TOWARDS HUMAN BODY

(75) Inventors: Se-hyun Park, Yongin-si (KR); Wee-sang Park, Yongin-si (KR); Yong-eil Kim, Yongin-si (KR); Jae-hee Kim, Pohang-si (KR)

(73) Assignees: Samsung Electronics Co., Ltd., Suwon-si (KR); Samsung Electro-Mechanics Co., Ltd, Suwon-si (KR)

( * ) Notice: Subject to any disclaimer, the term of this patent is extended or adjusted under 35 U.S.C. 154(b) by 12 days.

(21) Appl. No.: 11/634,865

(22) Filed: Dec. 7, 2006

(65) Prior Publication Data

US 2008/0001831 A1 Jan. 3, 2008

(30) Foreign Application Priority Data

Jun. 30, 2006 (KR) ..... 10-2006-0060440

(51) Int. Cl.
*H01Q 1/52* (2006.01)
*H01Q 1/24* (2006.01)

(52) U.S. Cl. ..... 343/841; 343/702; 343/846

(58) Field of Classification Search ..... 343/841, 343/702, 700 MS, 846
See application file for complete search history.

(56) References Cited

U.S. PATENT DOCUMENTS

| | | | | |
|---|---|---|---|---|
| 6,788,255 | B2 * | 9/2004 | Sakamoto et al. | 343/700 MS |
| 7,012,571 | B1 * | 3/2006 | Ozkar et al. | 343/702 |
| 2006/0214849 | A1 * | 9/2006 | Fabrega-Sanchez et al. | 343/700 MS |

FOREIGN PATENT DOCUMENTS

| | | | |
|---|---|---|---|
| KR | 1999-67637 | A | 8/1999 |
| KR | 2001-52847 | A | 6/2001 |

* cited by examiner

*Primary Examiner*—Hoang V Nguyen
(74) *Attorney, Agent, or Firm*—Sughrue Mion, PLLC

(57) ABSTRACT

A mobile terminal and a mobile terminal antenna reduce the intensity of electromagnetic waves radiated in the direction of a human body. The mobile terminal antenna includes a radiator, which radiates electromagnetic waves; a ground which is connected with the radiator, and a radiation preventer which has a metallic bar on one side of the ground in parallel with the ground at an interval. Accordingly, the electromagnetic radiation exposure to the human body can be reduced by altering the radiation emission pattern, while the performance of the antenna can be simultaneously enhanced.

6 Claims, 11 Drawing Sheets

MOBILE TERMINAL AND MOBILE TERMINAL ANTENNA FOR REDUCING ELECTROMAGNETIC WAVES RADIATED TOWARDS HUMAN BODY

CROSS-REFERENCE TO RELATED APPLICATIONS

This application claims priority under 35 U.S.C. § 119 from Korean Patent Application No. 10-2006-0060440 filed on Jun. 30, 2006, in the Korean Intellectual Property Office, the disclosure of which is incorporated herein by reference in its entirety.

BACKGROUND OF THE INVENTION

1. Field of the Invention

Apparatuses consistent with the principles of the present invention relate to a mobile terminal and a mobile terminal antenna characterized by reduced electromagnetic waves radiated in the direction of a human body. More particularly, the present invention relates to a mobile terminal and a mobile terminal antenna, which reduce electromagnetic waves radiated in the direction of a human body.

2. Description of the Related Art

Numerous experiments have demonstrated that electromagnetic waves generated by electronic devices or high-tension wires adversely affect a human body. To minimize adverse effects of electromagnetic radiation, various countries enacted laws aimed at limiting the electromagnetic radiation produced by electronic consumer products, while the manufacturers devoted a great deal of effort to minimizing electromagnetic radiation emitted by their products.

In particular, being used in close contact with a human body, a mobile terminal has a high specific absorption rate (SAR) level. The SAR is the amount of energy of the electromagnetic radiation that is absorbed by a human body per unit of mass of biological tissues when the mobile terminal is used. The SAR is affected by the near field region of the radio waves radiated from an antenna of the mobile terminal. The SAR is closely related to Tx power of the mobile terminal, antenna characteristics, and shape of the implementation.

The SAR, which is the measure of the amount of the electromagnetic radiation absorbed by the body, is adopted as a safe exposure limit for a human body. South Korea sets an allowable exposure level at 1.6[W/kg], while in the United States, Europe and Japan the allowable exposure level is set to 2.0[W/Kg].

Solutions aimed at lowering the SAR include the use of a directional antenna, shielding of radio waves by attaching an additional conductive plate, and insertion of a radio wave absorber.

The most common method for lowering the SAR is to design an antenna such that the distance between the mobile terminal and the human body is maximized when the mobile terminal is used. To this end, the antenna is designed such as to keep the printed circuit board of the mobile terminal at a certain distance away from the antenna. However, when the power is supplied to the antenna, the electric current from the antenna flows through the printed circuit board. Thus, the printed circuit board also operates as an antenna. That is, even when the antenna is kept away from the printed circuit board, the electric power supplied to the antenna flows through the printed circuit board connected for the power feed. As a result, the electromagnetic waves are generated by the aforesaid printed circuit board.

To block the flow of electric current from the antenna to the printed circuit board, a method involving installing a choke-type balun between the antenna and the printed circuit board has been suggested. However, this method is difficult to implement during the design phase of a mobile phone because the balun causes excessive separation of the antenna from the mobile terminal.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

In accordance with an aspect of the present invention, there is provided a mobile terminal and a mobile terminal antenna, which minimize radiation of electromagnetic waves in the direction of a human body.

According to an aspect of the present invention, a mobile terminal antenna includes a radiator, which radiates electromagnetic waves; a ground, which is connected with the radiator, and a radiation preventer which has a metallic bar disposed on one side of the ground in parallel thereto and being spatially separated from the ground.

The metallic bar of the radiation preventer may be implemented as a plurality of radiation preventing bars that are arranged along an electric field of the radiator, and the radiation preventing bars may be arranged at intervals across the electric field.

A connector may be formed along one end of the ground, in a substantially perpendicular direction with respect to the ends of the radiation preventing bars, such as to connect the ends of the radiation preventing bars with the ground.

The mobile terminal antenna may be a planar inverted F antenna (PIFA) including a feed pin which supplies current to the radiator and a shorting pin which drains the current circulating in the radiator to the ground, the feed pin and shorting pin being arranged to connect the radiator with the ground.

The length of the radiation preventing bar may be $\lambda/4$.

According to an aspect of the present invention, a mobile terminal includes a casing having inner surfaces covered with conductive paints in a stripe pattern; and an antenna comprising a ground electrically connected with the conductive paints, and a radiator operable to radiate electromagnetic waves and connected to the ground.

The casing may be covered with a plurality of paint strips, which are arranged along the electric field of the antenna, the paint strips being arranged at intervals across the electric field.

The casing may have a paint link connecting the paint strips and protruding from the inner surface of the casing.

The ground may be formed in a circuit board, and a metallic contact part may be formed in one side of the circuit board such as to form a contact with the paint link and to interconnect the ground with the paint link.

A length of each paint bar may be $\lambda/4$.

BRIEF DESCRIPTION OF THE DRAWINGS

The above aspects and features of the present invention will be more apparent by describing certain exemplary embodiments of the present invention with reference to the accompanying drawings, in which.

DETAILED DESCRIPTION OF THE EXEMPLARY EMBODIMENTS

Figure 1A:
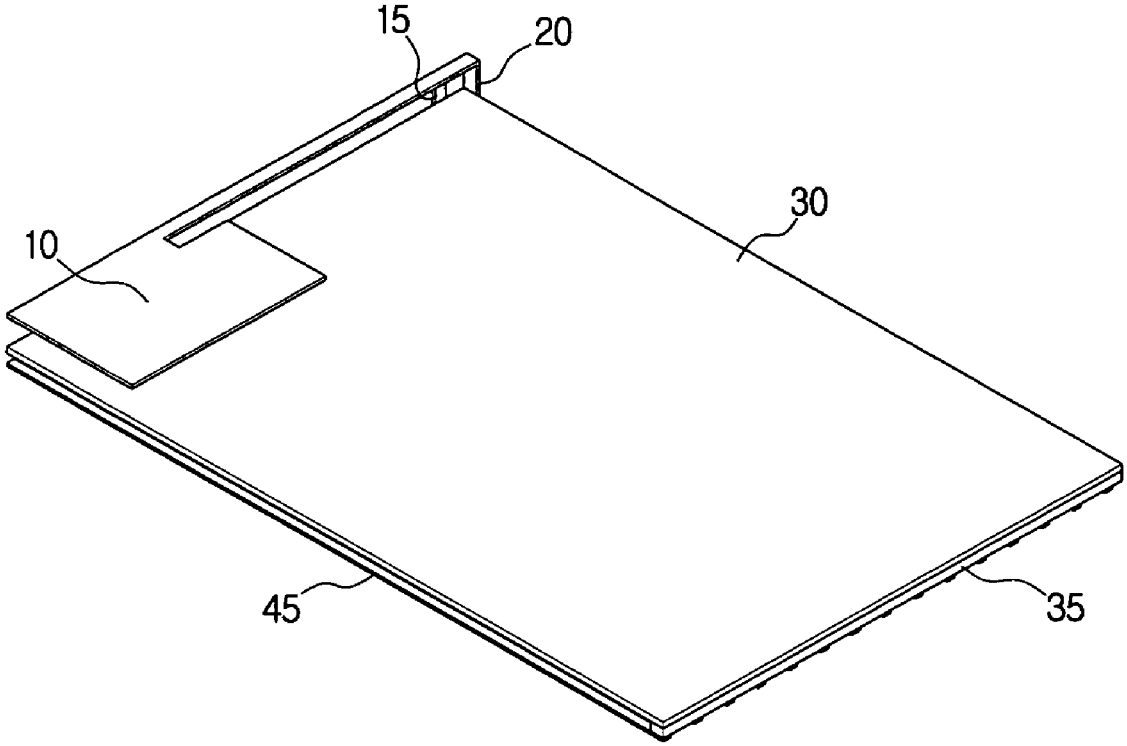
FIG. 1A is a perspective view of a radiator of a mobile terminal antenna according to an exemplary embodiment of the present invention.

Certain exemplary embodiments of the present invention will now be described in greater detail with reference to the accompanying drawings.

In the following description, the identical drawing reference numerals are used to refer to the equivalent elements, even in different drawings. The matters specified in the following description, such as detailed construction of the inventive apparatus, as well as descriptions of separate elements thereof, are provided for exemplary purposes only, in order to assist in a comprehensive understanding of the invention. Also, certain well-known functions or constructions are not described in detail, because they would obscure the invention in unnecessary detail.

Figure 1B:
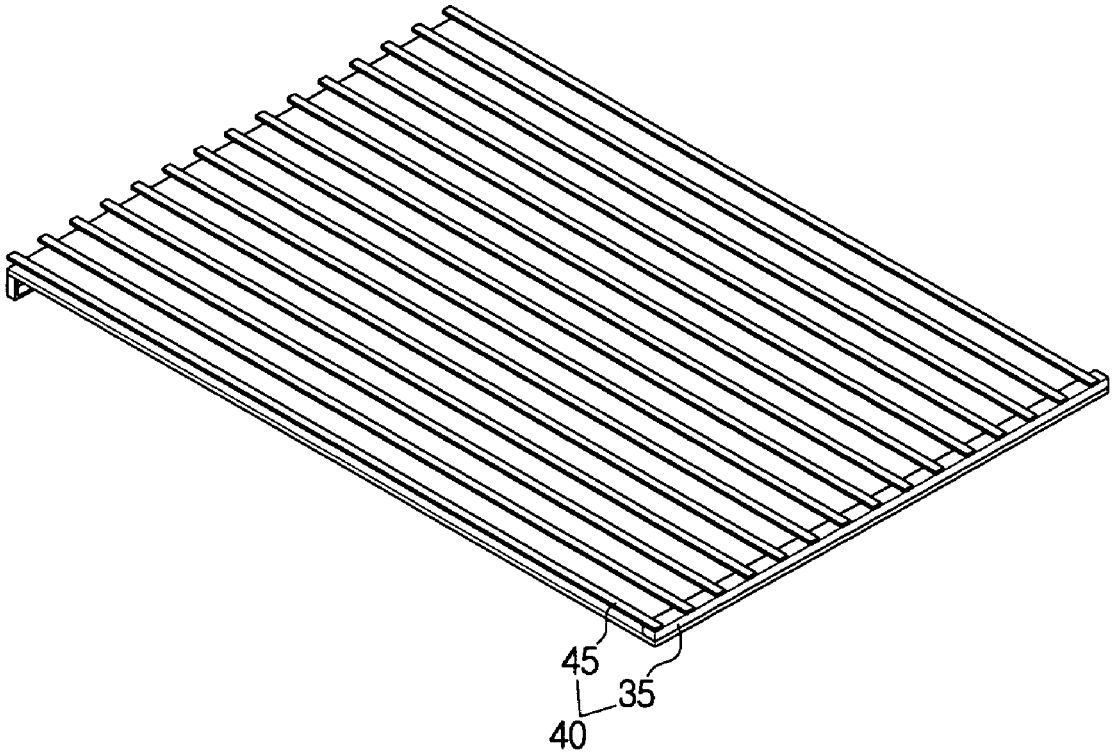
FIG. 1B is a perspective view of a radiation preventer of the mobile terminal antenna of FIG. 1A.

FIG. 1A is a perspective view of a radiator of a mobile terminal antenna according to an exemplary embodiment of the present invention, and FIG. 1B is a perspective view of a radiation preventer of the mobile terminal antenna of FIG. 1A.

Generally, speech quality of a mobile terminal is determined by a reception rate of radio waves transmitted from a base station. For good radio wave reception characteristics, a planer inverted F antenna (PIFA) having omi-directional characteristics is employed as the mobile terminal antenna The PIFA includes a radiator 10, a feed pin 15, a shorting pin 20, and a ground 30. A radiation preventer 40 (shown in FIG. 2) is positioned on the opposite side of the ground 30 with respect to the radiator 10.

The radiator 10 is separated from the ground 30 by a predetermined interval and runs in parallel with the ground 30. The radiator 10 operates to emit electromagnetic wave radiation.

The feed pin 15 interconnects the radiator 10 and the ground 30 and provides electric current to the radiator 10. The shorting pin 20 interconnects the radiator 10 and the ground 30 to drain the current circulating in the radiator 10 to the ground 30.

The ground 30 can be formed on a circuit board in either an integral or a separate manner. Due to the presence of the ground 30, the antenna size of λ/2 can be reduced to λ/4. Accordingly, the length of the ground 30 is about λ/4.

The radiation preventer 40 is arranged to face the radiator 10 and is centered with respect to the ground 30. The radiation preventer 40 is spatially separated from the ground 30 and is positioned in parallel with the ground 30. The radiation preventer 40 includes a plurality of radiation preventing bars 45 arranged in series and positioned at intervals, and a connector 35, which connects the radiation preventing bars 45 with one end of the ground 30.

The radiation preventing bar 45 can be implemented using a metallic wire or a metallic plate. The longitudinal direction of the radiation preventing bar 45 is parallel to the direction of vertical polarization of the antenna The length of the radiation preventing bar 45 is approximately λ/4, which is also the length of the ground 30.

The connector 35 has a shape of a strip, and connects one end of each of the radiation preventing bars 45 with one end of the ground 30. The radiation preventing bars 45 and the ground 30 are spatially separated by a distance corresponding to the thickness of the connector 35. In one example, the radiator 10 may be mounted at the upper end of the ground 30, while the connector 35 is mounted at the lower end of the ground 30.

More specifically, the radiator 10 may be mounted at the upper end of one side of the ground 30, while the connector 35 is mounted at the lower end of the other side of the ground 30.

Figure 2A:
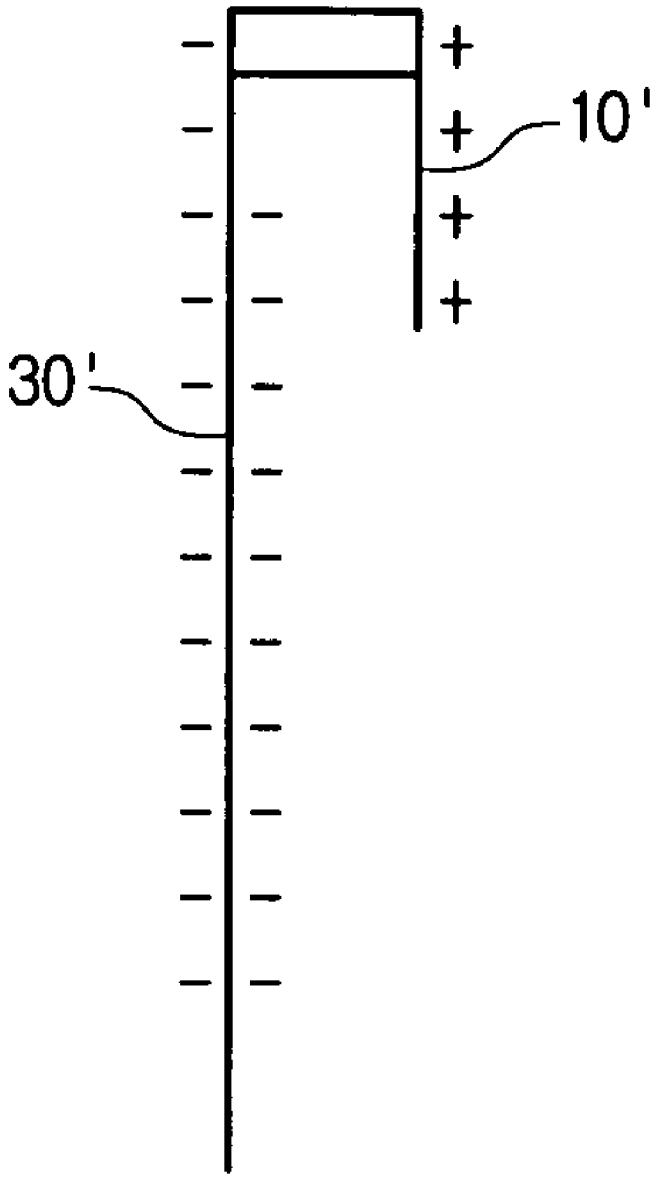
FIG. 2A (PRIOR ART)
FIG. 2A is a side view of distribution of electric charges of a conventional mobile terminal antenna.
Figure 2B:
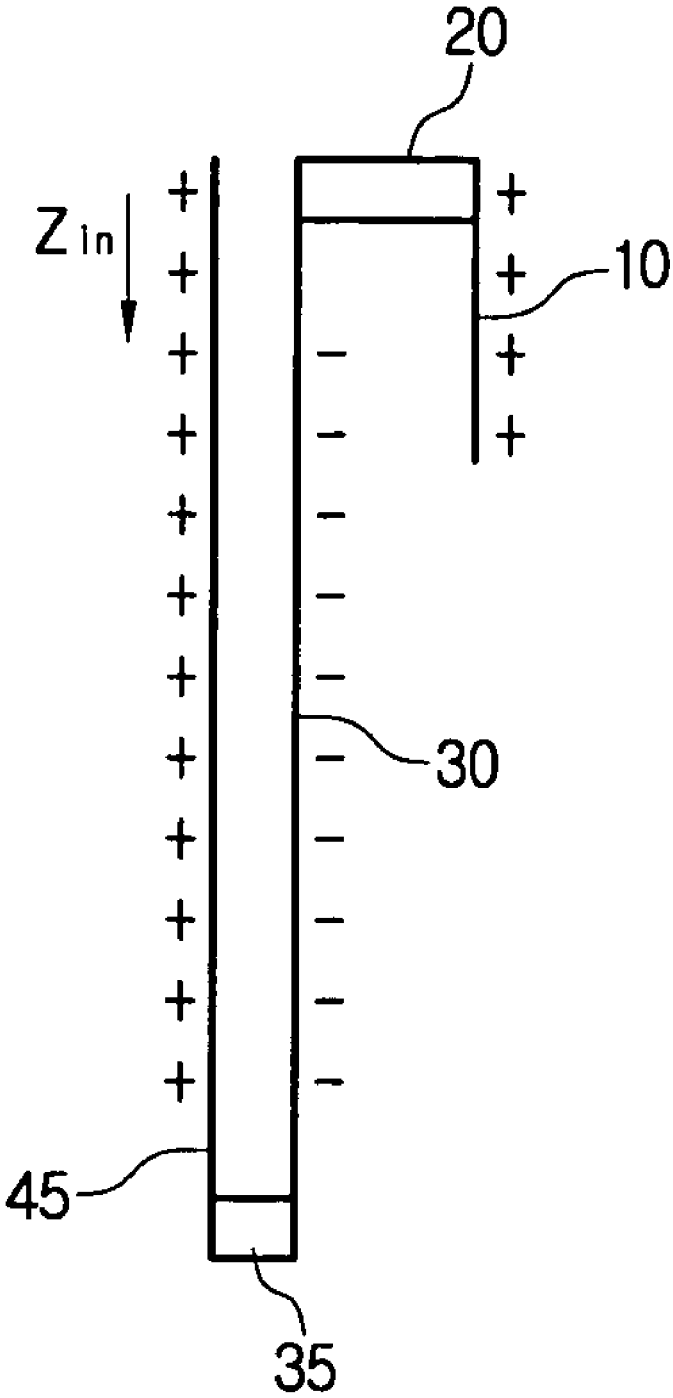
FIG. 2B is a side view of the mobile terminal antenna according to an exemplary embodiment of the present invention.

FIG. 2A is a side view showing electric charge distribution in a conventional mobile terminal antenna, and FIG. 2B is the respective side view corresponding the mobile terminal antenna according to an exemplary embodiment of the present invention.

Figure 3A:
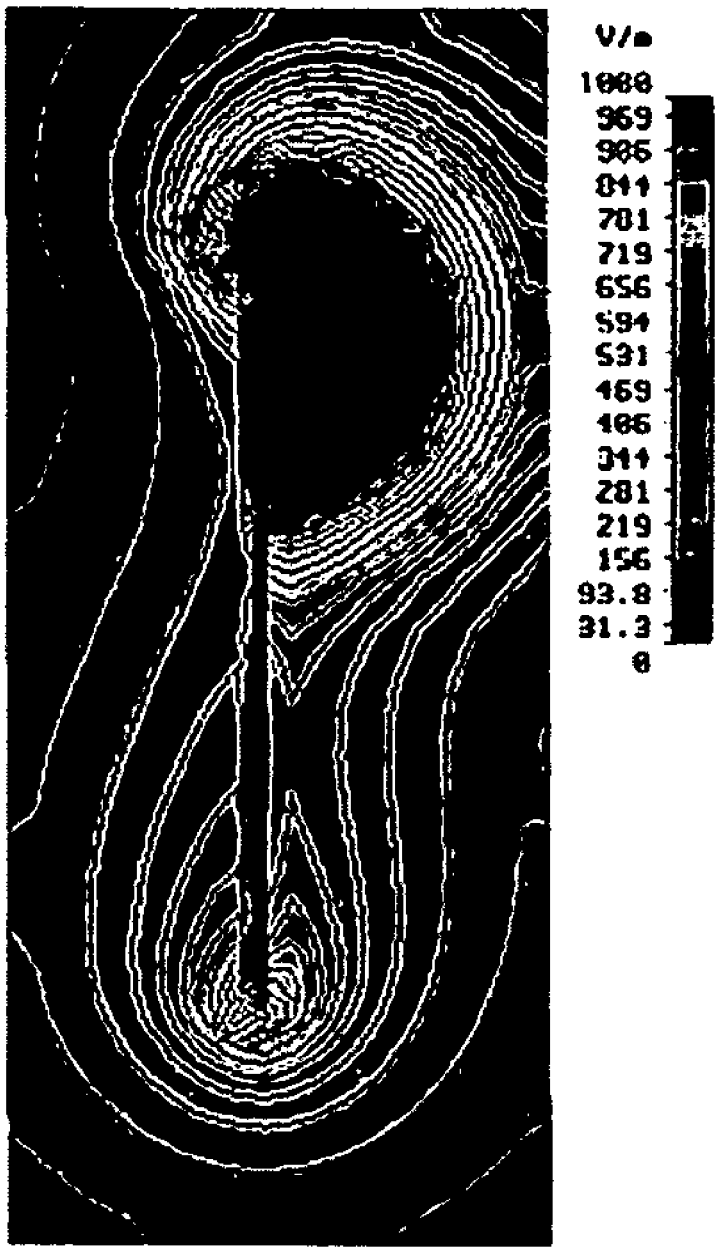
FIG. 3A (PRIOR ART)
FIG. 3A is a graph showing electric field of the conventional mobile terminal antenna.

In the conventional mobile terminal antenna, the ground 30' carries (−) charge and the radiator 10' carries (+) charge. The electric current flows from the (+) charge to the (−) charge. The aforesaid electric current flow results in generation of fringing field, due to the fact that the electromagnetic waves from the radiator 10' reach the ground 30' as shown in FIG. 3A. As the mobile terminal antenna is mounted such that the ground 30' faces the front side of the mobile terminal antenna and the radiator 10' faces the rear side, the fringing field at the ground 30' is directed towards the human body.

Figure 3B:
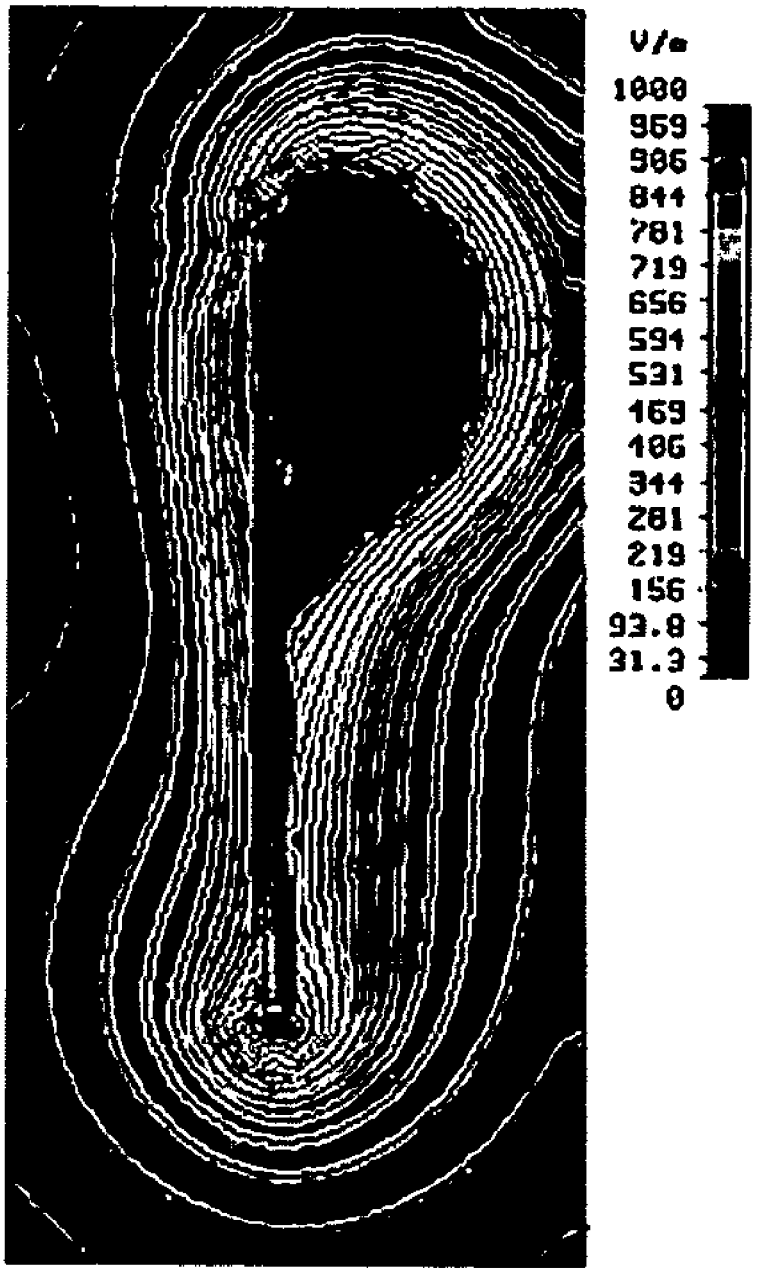
FIG. 3B is a graph showing electric field of the mobile terminal antenna according to an exemplary embodiment of the present invention.

By contrast, in the mobile terminal antenna according to an exemplary embodiment of the present invention, the radiator 10 is positioned on one side of the ground 30, while the radiation preventer 40 is positioned on the other side thereof. Thus, the radiator 10 and the radiation preventing bar 45 carries (+) charge, whereas the ground 30 carries (−) charge, as shown in FIG. 2B. As a result, because the radiator 10 and the radiation preventing bar 45 are in the same phase, the inventive configuration blocks the electric field from being generated from the radiator 10 to the radiation preventing bar 45. Thus, it is apparent that the fringing field generated around the ground 30 is minimal, as shown in FIG. 3B.

It should be noted that impedance of the antenna is generally determined based on Equation 1.

$$Z_{in}=j*Z_0 \tan \beta l \qquad \text{[Equation 1]}$$

When calculating the impedance of the radiation preventer 40 based on Equation 1, $Z_{in}$ is an input impedance of the radiation preventer 40 and l is the length of the radiation preventer 40. Because the length l of the radiation preventer 40 is λ/4, the value of $Z_{in}$ becomes ∞. Thus, the fringing field is not generated because the electric current cannot flow into the radiation preventer 40.

Figure 4A:
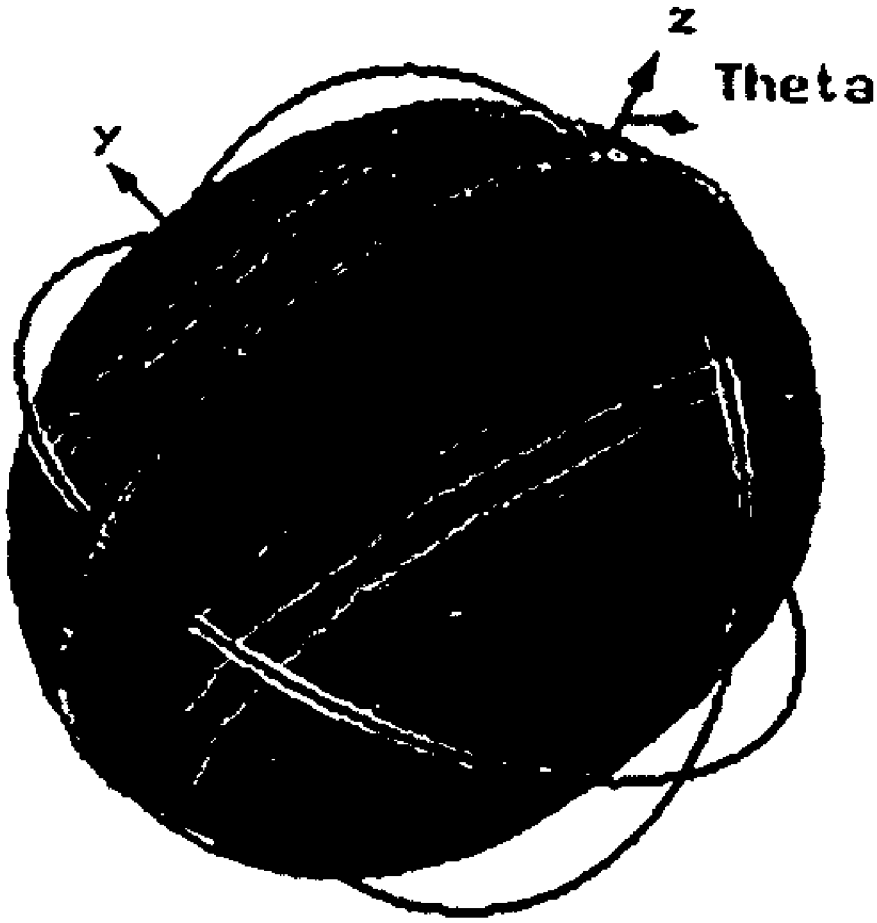
FIG. 4A (PRIOR ART)
FIG. 4A depicts a three-dimensional radiation pattern of the conventional mobile terminal antenna.
Figure 4B:
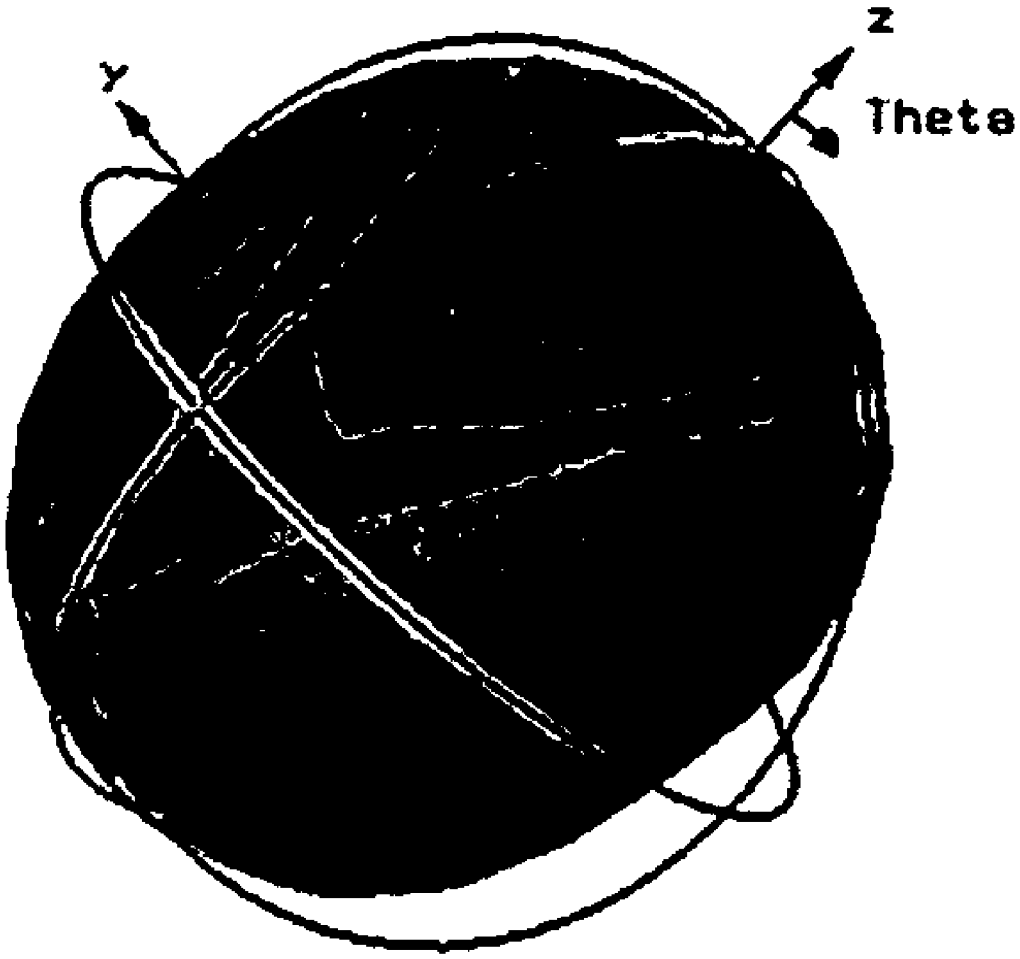
FIG. 4B depicts a three-dimensional radiation pattern of the mobile terminal antenna according to an exemplary embodiment of the present invention.

FIG. 4A depicts a three-dimensional radiation pattern of a conventional mobile terminal antenna, and FIG. 4B depicts a three-dimensional radiation pattern of the mobile terminal antenna according to an exemplary embodiment of the present invention. In the shown plots, x-axis and y-axis lie in the plane of the ground 30, while z-axis lies perpendicular to the ground 30.

Referring to FIG. 4A, the conventional mobile terminal antenna has the radiation pattern having omi-directional characteristics, and produces certain degree of radiation directivity toward the z-axis.

Figure 5:
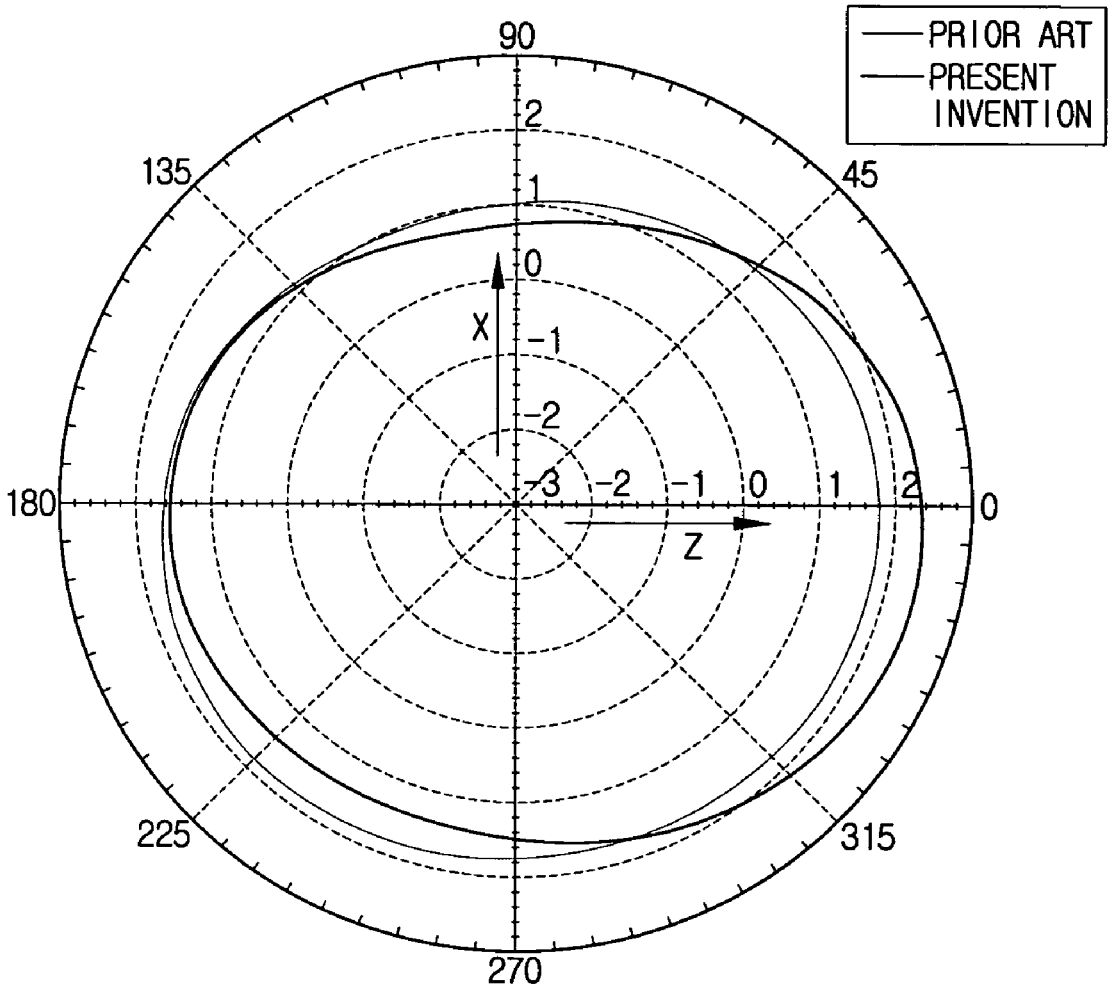
FIG. 5 depicts two-dimensional radiation patterns of the conventional mobile terminal antenna and the mobile terminal antenna of the present invention.

In contrast, the mobile terminal antenna in accordance with the present invention produces higher degree of electromagnetic wave directivity toward the z-axis as shown in FIG. 4B, when compared with the conventional mobile terminal antenna FIG. 5 depicts two dimensional radiation patterns of the conventional mobile terminal antenna and the mobile terminal antenna of the present invention and, specifically, xz-plane views of the respective radiation patterns. As shown in FIG. 5, the radiation pattern of the conventional mobile terminal antenna exhibits omnidirectional radiation distribution, whereas the radiation pattern of the mobile terminal antenna of the present invention exhibits radiation directivity toward the z-axis. In the latter configuration, the radiation decreases in the direction of −z-axis facing the human body and increases in the direction of +z-axis.

Figure 6A:
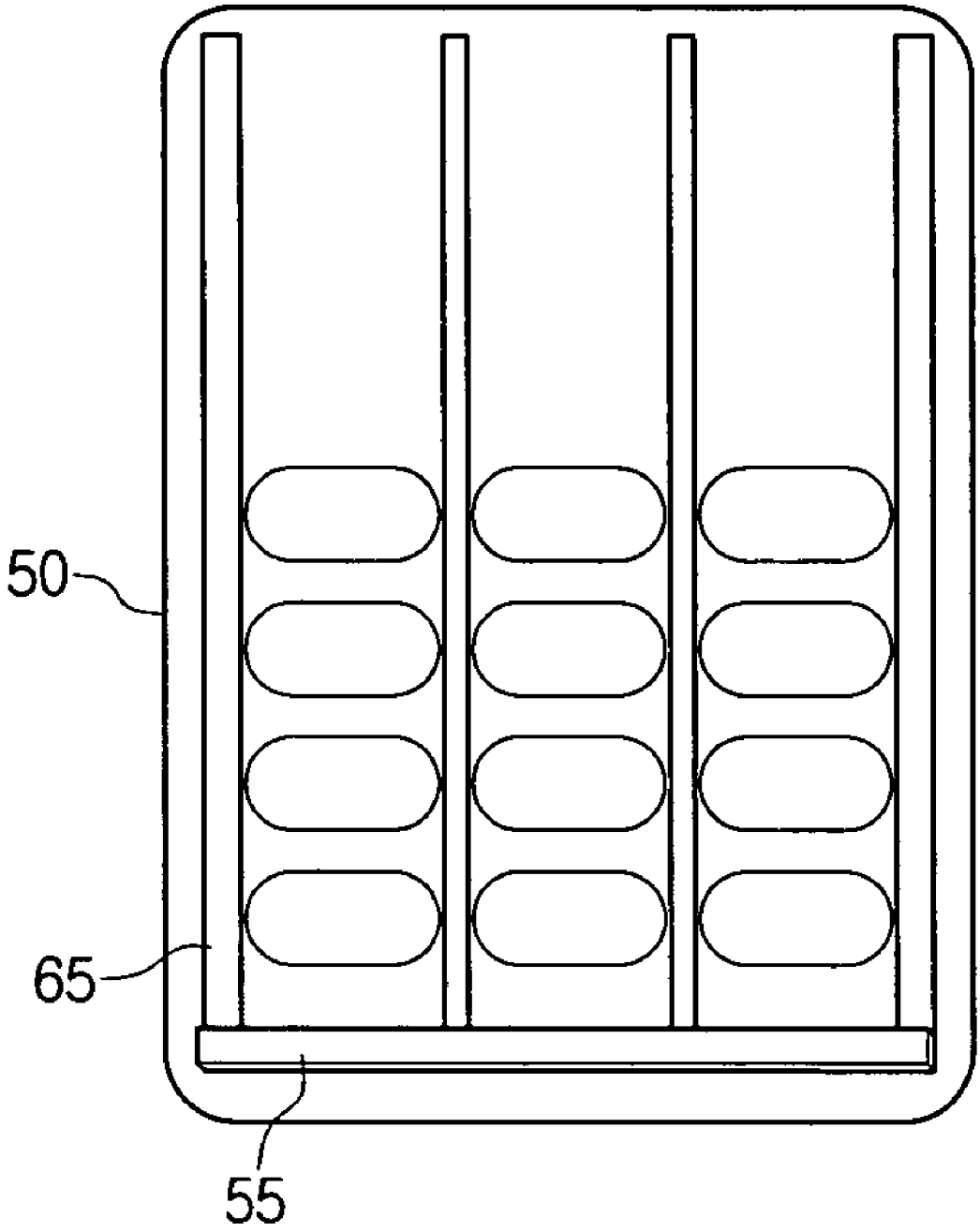
FIG. 6A is a plane view of interior of a casing of a mobile terminal antenna according to another exemplary embodiment of the present invention.

In the inventive antenna configuration, with the radiation decreasing in the direction of −z-axis, the gain of the antenna increases. According to measurement of the actual gain, the conventional mobile terminal antenna has the gain of 2.019 dB, whereas the mobile terminal antenna of the present invention has the gain of 2.502 dB. That is, the gain of the mobile terminal antenna of the present invention is improved by approximately 0.5 dB, in comparison with the conventional antenna FIG. 6A is a plane view of the interior of a casing of a mobile terminal antenna according to another exemplary embodiment of the present invention, and FIG. 6B is a plane view of the corresponding circuit board.

In one embodiment of the invention, conductive paints are applied to inner surfaces of the casing 50 of the mobile terminal in order to block the radiation of the electromagnetic waves radiated from circuit parts mounted on the circuit board. In an embodiment of the present invention, the conductive paints are spread over the inner surfaces of the casing 50 in a strip shape. To this end, a plurality of paint strips 65 is formed along the direction of the electric field generated at the antenna and arranged at intervals across the electric field. It is preferable to set the length of the paint strip 65 to λ/4, as the length of the radiation preventing bar 45

A paint link 55 is formed at one end of the paint bars 65 to interconnect the paint bars 65, and to electrically connect them to the ground. The paint link 55 protrudes from the inside of the casing 50 by a certain amount such as to establish an electrical contact with the circuit board 70 carrying the ground.

Figure 6B:
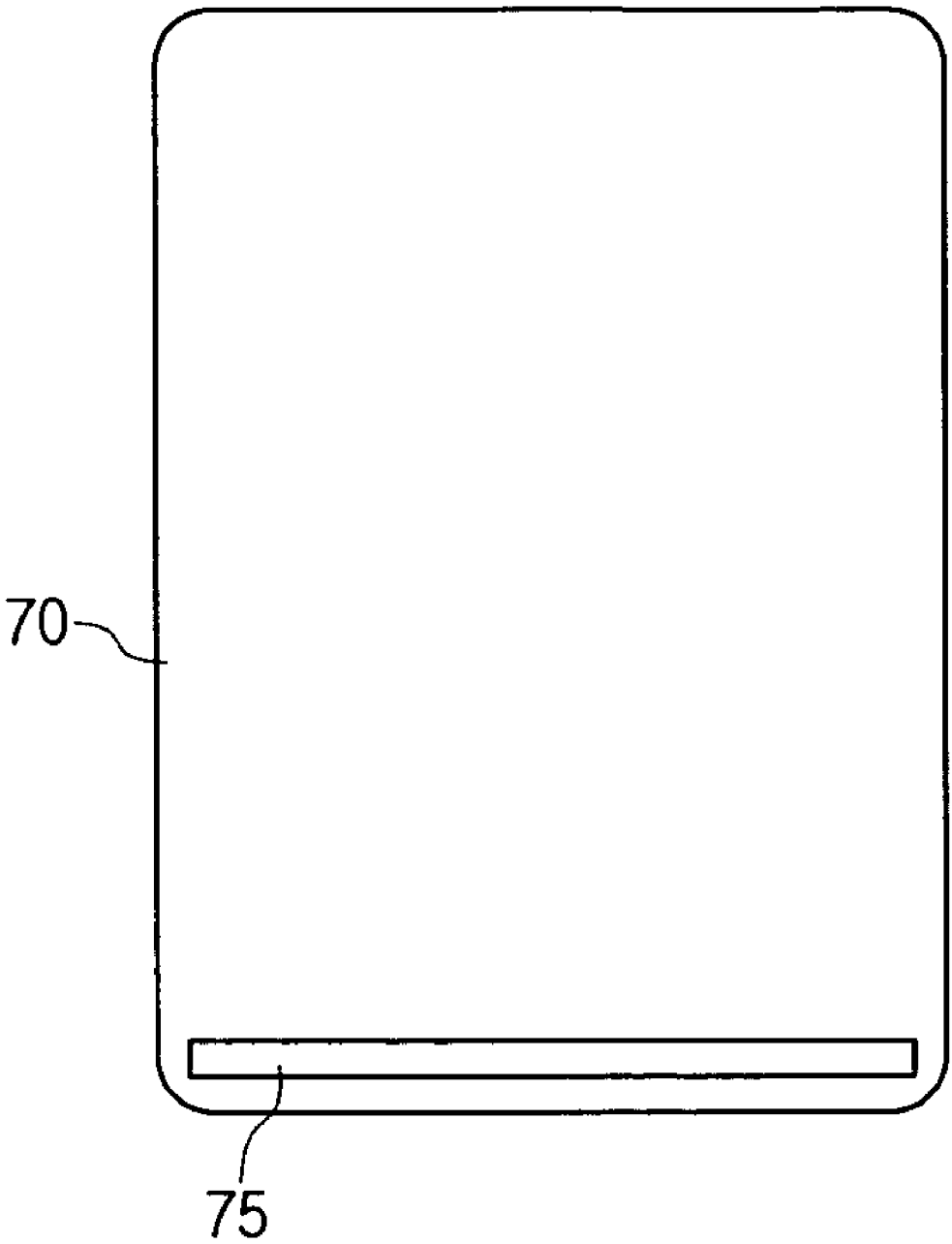
FIG. 6B is a plane view of a circuit board within the casing of FIG. 6A.

Referring now to FIG. 6B, a strip-shaped contact part 75 is formed at one end of the circuit board 70. When the mobile terminal is assembled, the contact part 75 establishes a contact with the paint link 55 of the casing 50. The contact part 75 is electrically connected to the ground 30.

Thus, the embodiment of the inventive mobile terminal, provides the lengthy radiation preventing bar 45 or paint strip 65 along the direction of the electric field. The mobile terminal antenna of the present invention produces the radiation pattern having the omi-directional characteristics with respect to the z-axis. Therefore, the fringing field is eliminated and the amount of electromagnetic radiation generated in the direction of the human body is reduced. Additionally, the inventive antenna is characterized by enhanced performance characteristics due to the increased gain.

In the embodiment of the present invention, the PIFA is exemplified as the mobile terminal antenna. It is to be appreciated that the present invention is applicable to any antennas, which can be mounted on the mobile terminal and have omi-directional characteristics.

As set forth above, the amount of electromagnetic radiation in the direction of the human body can be reduced by altering the radiation emission pattern, while the performance of the antenna can be simultaneously enhanced.

While the present invention has been particularly shown and described with reference to exemplary embodiments thereof, it will be understood by those skilled in the art that various changes in form and details may be made therein without departing from the spirit and scope of the invention as defined by the appended claims.

What is claimed is:

1. A mobile terminal antenna comprising:

a radiator operable to radiate electromagnetic waves;

a ground connected to the radiator;

a radiation preventer comprising a metallic bar disposed on one side of the ground, the metallic bar being spatially separated from the ground and positioned in parallel with the ground; and a connector formed along one end of the ground, connecting an end of the metallic bar with the ground.

2. The mobile terminal antenna of claim 1, wherein the metallic bar of the radiation preventer comprises a plurality of radiation preventing bars arranged along an electric field of the radiator, the radiation preventing bars being arranged at intervals across the electric field.

3. The mobile terminal antenna of claim 2, wherein the connector is arranged in a substantially perpendicular direction with respect to ends of the radiation preventing bars.

4. The mobile terminal antenna of claim 1, wherein the mobile terminal antenna is a planar inverted F antenna (PIFA) including a feed pin operable to supply current to the radiator and a shorting pin operable to drain the current circulating in the radiator to the ground, the feed pin and shorting pin connecting the radiator to the ground.

5. The mobile terminal antenna of claim 2, wherein a length of the radiation preventing bar is λ/4.

6. A mobile terminal antenna comprising:

a radiator operable to radiate electromagnetic waves;

a ground connected to the radiator;

a radiation preventer comprising a plurality of metallic radiation preventing bars disposed on one side of the ground, the plurality of metallic radiation preventing bars being spatially separated from the ground and positioned in parallel with the ground, wherein said metallic radiation preventing bars are arranged along an electric field of the radiator, and are arranged at intervals across the electric field; and a connector formed along one end of the ground, the connector being arranged in a substantially perpendicular direction with respect to ends of the metallic radiation preventing bars, and connecting the ends of the metallic radiation preventing bars with the ground.

* * * * *